US006986180B1

(12) United States Patent
Wilke

(10) Patent No.: US 6,986,180 B1
(45) Date of Patent: Jan. 17, 2006

(54) BED

(76) Inventor: Hans Joachim Wilke, Birkenweg 1, 89160 Dornstadt Bollingen (DE)

( * ) Notice: Subject to any disclaimer, the term of this patent is extended or adjusted under 35 U.S.C. 154(b) by 269 days.

(21) Appl. No.: 10/110,847

(22) PCT Filed: Oct. 25, 2000

(86) PCT No.: PCT/EP00/10477

§ 371 (c)(1),
(2), (4) Date: Sep. 16, 2002

(87) PCT Pub. No.: WO01/30294

PCT Pub. Date: May 3, 2001

(30) Foreign Application Priority Data

Oct. 25, 1999 (DE) ..... 199 13 112

(51) Int. Cl.
*A61G 7/057* (2006.01)

(52) U.S. Cl. ..... 5/618; 5/613; 340/573.1

(58) Field of Classification Search ..... 5/613, 5/614, 615, 616, 617, 618, 619; 340/573.1, 340/575

See application file for complete search history.

(56) References Cited

U.S. PATENT DOCUMENTS

| | | | | |
|---|---|---|---|---|
| 4,435,862 A | * | 3/1984 | King et al. | 5/611 |
| 4,999,861 A | * | 3/1991 | Huang | 5/616 |
| 5,023,967 A | * | 6/1991 | Ferrand | 5/607 |
| 5,101,519 A | * | 4/1992 | Yamamoto | 5/614 |
| 5,802,640 A | * | 9/1998 | Ferrand et al. | 5/617 |

FOREIGN PATENT DOCUMENTS

| | | |
|---|---|---|
| DE | GM 74 35 067 | 2/1975 |
| DE | G 84 32 699.9 | 3/1985 |
| DE | 197 01 698 A1 | 7/1998 |
| DE | 199 12 916 A1 | 9/2000 |
| EP | 0 115 056 | 8/1984 |
| EP | 0 123 078 | 10/1984 |
| EP | 0 364 394 | 4/1990 |
| EP | 0 374 742 | 6/1990 |
| FR | 2087577 | 12/1971 |
| FR | 2764499 | 12/1998 |
| WO | WO 98/22071 | 5/1998 |
| WO | WO 98/34577 | 8/1998 |
| WO | WO 01/30294 A1 | 5/2001 |

OTHER PUBLICATIONS

"Neue intradiskale In–vivo Druckmessungen bei Alltagsbelastungen", H. J. Wilke, P. Neef, M. Caimi, T. Hoogland, L. E. Claes, Springer–LVerlag Berlin Heidelberg 1999.

"New In Vivo Measurements of Pressures in the Intervertebral Disc in Daily Life,"H.J. Wilke, PhD., Peter Neef, M.D., Marco Caimi, M.D., Thomas Hoogland, M.D., Spine, vol. 24, No. 8, pp. 755 Apr. 15, 1999.

International Search Report for PCT/EP/10477, dated Feb. 14, 2001.

* cited by examiner

*Primary Examiner*—Frederick L. Lagman
(74) *Attorney, Agent, or Firm*—Young & Basile, P.C.

(57) ABSTRACT

A reclining device (1) is described having a support (10) which can be moved back and forth between different positions automatically and continuously, so that the spinal column and other joints, for example of the hip, knee, leg, can be moved and exercised specifically.

23 Claims, 30 Drawing Sheets

Movement Programs for Motor Control

| Pr. No. | Sketch | Motor 1 Head | | | Motor 2 Back | | | Motor 3 Lumbar vertebrae | | |
|---|---|---|---|---|---|---|---|---|---|---|
| | | Travel (°) | v | t (min) | Travel (°) | v | t (min) | Travel (mm) | v | t (min) |
| | | | | | | | | | | |
| | | | 0 | | | | | | | |
| | | | 0 | | | | | | | |
| | | | 0 | | | | | | | |
| | | | | | | | | | | |
| | | -5° | 0 | | | | | | | |
| | | -5° to 15° | v1 | | | | | | | |
| | | -5° to 15° | v2 | | | | | | | |
| | | -5° to 15° | v3 | | | | | | | |
| | | | | | | | | 20 to 50 | v1 | |
| | | | | | | | | 20 to 50 | v2 | |
| | | | | | | | | 20 to 50 | v3 | |

Fig. 13 (top left)

| Motor 4 Leg | | | Motor 5 Knee | | | Comment |
|---|---|---|---|---|---|---|
| Travel (°) | v | t (min) | Travel (°) | v | t (min) | |
| | | | | | | **Basic Settings** |
| | | | | | | Normal basic position |
| | | | | | | -4° for veins - (special basic position) |
| | | | | | | +4° stomach angle - (special basic position) |
| | | | | | | Movement programs in the lying position |
| | | | | | | Anti-snore setting or anti-apnea position |
| | | | | | | Exercise for the cervical vertebrae |
| | | | | | | |
| | | | | | | |
| | | | | | | Exercise for the lumbar vertebrae with flexible vertebrae |
| | | | | | | |
| | | | | | | |

Fig. 13 (top right)

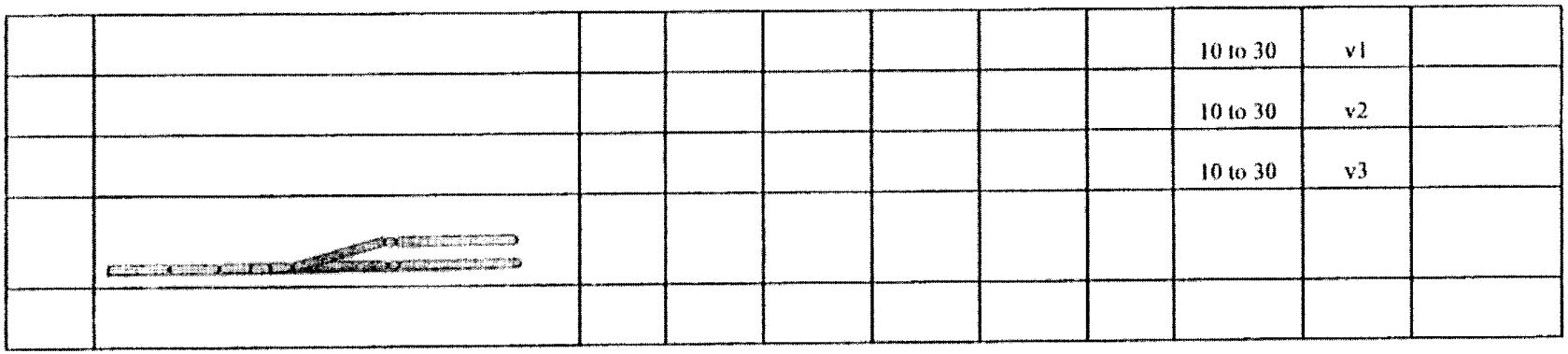
Movement in ° or mm
v1 = rapid (4-8 sec. per cycle)
v2 = medium (1 minute per cycle)
v3 = slow (10 minutes per cycle)
Fig. 13 (lower left)

| | | | | | | | | |
|---|---|---|---|---|---|---|---|---|
| | | | | | | | | Y stiff lumbar vertebrae |
| | | | | | | | | |
| | | | | | | | | |
| | | | | | | | | Exercise for the hip |
| | | | | | | | | |
| | | | | | | | | |
| | | | | | | | |

Movement Programs for Motor Control
| Pr. No. | Sketch | Motor 1 Head | | | Motor 2 Back | | | Motor 3 Lumbar vertebrae | | |
|---|---|---|---|---|---|---|---|---|---|---|
| | | Travel (°) | v | t (min) | Travel (°) | v | t (min) | Travel (mm) | v | t (min) |
| | | | | | | | | | | |
| | 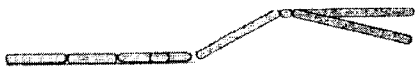 | | | | | | | | | |
| | | | | | | | | | | |
| | | | | | | | | | | |
| | | | | | | | | | | |
| | | | | | | | | | | |
| | 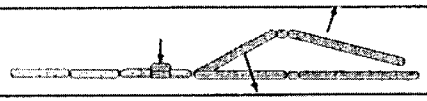 | | | | | | | | | |
| | | | | | | | | | | |
| | | | | | | | | | | |
| | | | | | | | | | | |
| | | | | | | | | | | |
| | 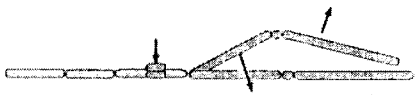 | | | | | | | 20 to 50 | v1 | |
| | | | | | | | | 20 to 50 | v2 | |
| | | | | | | | | 20 to 50 | v3 | |
Fig. 14 (top left)

| Motor 4 Leg | | | Motor 5 Knee | | | Comment |
|---|---|---|---|---|---|---|
| Travel (°) | v | t (min) | Travel (°) | v | t (min) | |
| 0° to 30° | v3 | | | | | |
| 30° | 0 | | 15° to 0° | v1 | | Exercise for the knee |
| | | | 15° to 0° | v2 | | |
| | | | 15° to 0° | v3 | | |
| | | | | | | |
| | | | | | | |
| 0° to 30° | v1 | | 15° to 0° | v1 | | Exercise for the hip and the knee |
| 0° to 30° | v2 | | 15° to 0° | v2 | | |
| 0° to 30° | v3 | | 15° to 0° | v3 | | |
| | | | | | | |
| | | | | | | |
| 0° to 30° | v1 | | 15° to 0° | v1 | | Exercise for the lumbar vertebrae, the hip and knee |
| 0° to 30° | v2 | | 15° to 0° | v2 | | |
| 0° to 30° | v3 | | 15° to 0° | v3 | | |

Fig. 14 (top right)

| | | | | | | | | | | |
|---|---|---|---|---|---|---|---|---|---|---|
| | | | | | | | | 10 to 30 | v1 | |
| | | | | | | | | 10 to 30 | v2 | |
| | | | | | | | | 10 to 30 | v3 | |
| | | | | | | | | | | |
| | | -5° to 15° | v1 | | | | | 20 to 50 | v1 | |
| | | -5° to 15° | v2 | | | | | 20 to 50 | v2 | |
| | | -5° to 15° | v3 | | | | | 20 to 50 | v3 | |
| | | | | | | | | 10 to 30 | v1 | |
| | | | | | | | | 10 to 30 | v2 | |

Movement in ° or mm v1 = rapid (4-8 sec. per cycle)
v2 = medium (1 minute per cycle)
v3 = slow (10 minutes per cycle)

Fig. 14 (lower left)

| | | | | | | |
|---|---|---|---|---|---|---|
| 0 ° to 30 ° | v1 | | 15° to 0° | v1 | | |
| 0 ° to 30 ° | v2 | | 15° to 0° | v2 | | |
| 0° to 30 ° | v3 | | 15° to 0° | v3 | | |
| | | | | | | |
| 0 ° to 30 ° | v1 | | 15° to 0° | v1 | | Exercise for the lumbar and cervical vertebrae, hip and knee |
| 0 ° to 30 ° | v2 | | 15° to 0° | v2 | | |
| 0 ° to 30 ° | v3 | | 15° to 0° | v3 | | |
| 0 ° to 30 ° | v1 | | 15° to 0° | v1 | | |
| 0 ° to 30 ° | v2 | | 15° to 0° | v2 | | |

Time in minutes

Fig. 14 (lower right)

Movement Programs for Motor Control

| Pr. No. | Sketch | Motor 1 Head | | | Motor 2 Back | | | Motor 3 Lumbar vertebrae | | |
|---|---|---|---|---|---|---|---|---|---|---|
| | | Travel (°) | v | t (min) | Travel (°) | v | t (min) | Travel (mm) | v | t (min) |
| | | | | | | | | 10 to 30 | v3 | |
| | | | | | | | | | | |
| | | | | | | | | | | |
| | | | | | | | | | | |
| | | -5 ° to 15 ° | v1 | | 30° | 0 | | | | |
| | | -5 ° to 15 ° | v2 | | 30° | 0 | | | | |
| | | -5 ° to 15 ° | v3 | | 30° | 0 | | | | |
| | | | | | | | | | | |
| | | | | | 30° | 0 | | 20 to 50 | v1 | |
| | | | | | 30° | _ | | 20 to 50 | v2 | |
| | | | | | 30° | 0 | | 20 to 50 | v3 | |
| | | | | | | | | 10 to 30 | v1 | |
| | | | | | | | | 10 to 30 | v2 | |
| | | | | | | | | 10 to 30 | v3 | |

Fig. 15 (top left)

| Motor 4 Leg | | | Motor 5 Knee | | | Comment |
|---|---|---|---|---|---|---|
| Travel( °) | v | t (min) | Travel (°) | v | t (min) | |
| 0° to 30° | v3 | | 15° to 0° | v3 | | |
| | | | | | | |
| | | | | | | |
| | | | | | | **Movement programs in the relaxed position** |
| | | | | | | Exercise for the cervical vertebrae |
| | | | | | | |
| | | | | | | |
| | | | | | | |
| | | | | | | Exercise for the lumbar vertebrae |
| | | | | | | |
| | | | | | | |
| | | | | | | |
| | | | | | | |
| | | | | | | |

Fig. 15 (top right)

| | | | | | | | | | | |
|---|---|---|---|---|---|---|---|---|---|---|
| | | | | | | | | | | |
| | | -5° to 15° | v1 | | 30° | 0 | | 20 to 50 | v1 | |
| | | -5° to 15° | v2 | | 30° | 0 | | 20 to 50 | v2 | |
| | | -5° to 15° | v3 | | 30° | 0 | | 20 to 50 | v3 | |
| | | -5° to 15° | v1 | | 30° | 0 | | 10 to 30 | v1 | |
| | | -5° to 15° | v2 | | 30° | 0 | | 10 to 30 | v2 | |
| | | -5° to 15° | v3 | | 30° | 0 | | 10 to 30 | v3 | |

Movement in° or mm v1 = rapid (4-8 sec. per cycle)
v2 = medium (1 minute per cycle)
v3 = slow (10 minutes per cycle)

Fig. 15 (lower left)

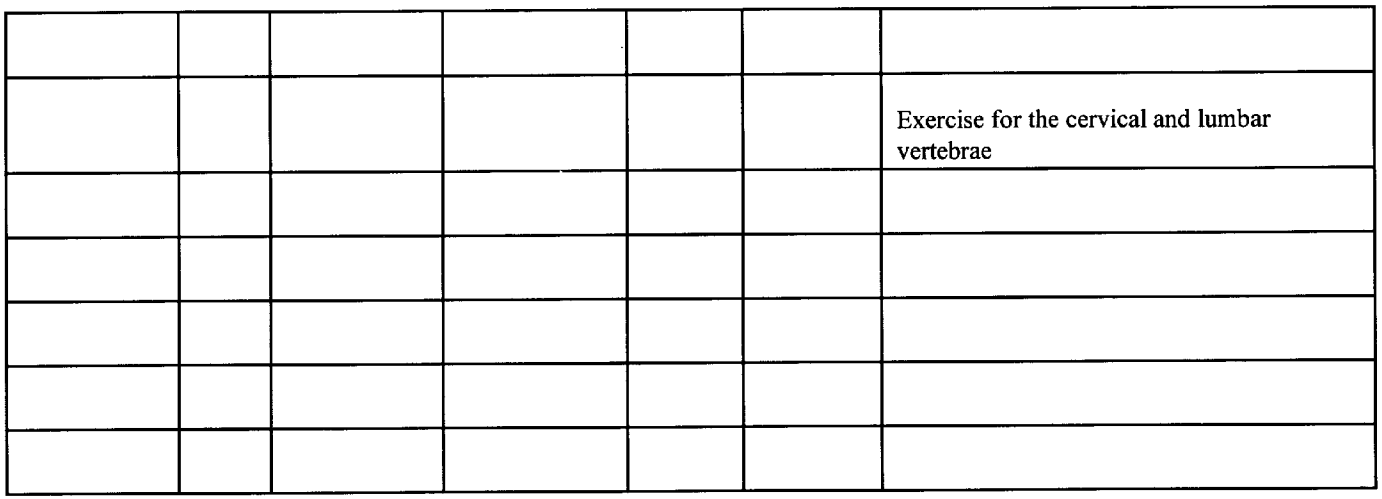
Time in minutes
Fig. 15 (lower right)

Movement Inputs for Motor Control

| Pr. No. | Sketch | Motor 1 Head | | | Motor 2 Back | | | Motor 3 Lumbar vertebrae | | |
|---|---|---|---|---|---|---|---|---|---|---|
| | | Travel (°) | v | t (min) | Travel (°) | v | t (min) | Travel (mm) | v | t (min) |
| | | | | | | | | | | |
| | | | | | 30° | 0 | | | | |
| | | | | | 30° | 0 | | | | |
| | | | | | 30° | 0 | | | | |
| | | | | | | | | | | |
| | | | | | | | | | | |
| | | | | | | | | | | |
| | | -5° to 15° | v1 | | 30° | 0 | | 20 to 50 | v1 | |
| | | -5° to 15° | v2 | | 30° | 0 | | 20 to 50 | v2 | |
| | | -5° to 15° | v3 | | 30° | 0 | | 20 to 50 | v3 | |
| | | -5° to 15° | v1 | | 30° | 0 | | 10 to 30 | v1 | |
| | | -5° to 15° | v2 | | 30° | 0 | | 10 to 30 | v2 | |
| | | -5° to 15° | v3 | | 30° | 0 | | 10 to 30 | v3 | |
| | | | | | | | | | | |

Fig. 16 (top left)

| Motor 4 Leg | | | Motor 5 Knee | | | Comment |
|---|---|---|---|---|---|---|
| Travel (_) | v | t (min) | Travel (°) | v | t (min) | |
| | | | | | | |
| 15° - 30° | v1 | | 15° - 0° | v1 | | Exercise for the hip and the knee |
| 15° - 30° | v2 | | 15° - 0° | v2 | | |
| 15° - 30° | v3 | | 15° - 0° | v3 | | |
| | | | | | | |
| | | | | | | |
| | | | | | | |
| 15° - 30° | v1 | | 15° - 0° | v1 | | Exercise for the lumbar and cervical vertebrae, the hip and the knee |
| 15° - 30° | v2 | | 15° - 0° | v2 | | |
| 15° - 30° | v3 | | 15° - 0° | v3 | | |
| 15° - 30° | v1 | | 15° - 0° | v1 | | |
| 15° - 30° | v2 | | 15° - 0° | v2 | | |
| 15° - 30° | v3 | | 15° - 0° | v3 | | |
| | | | | | | |

Fig. 16 (top right)

| | | | | | | | | | | |
|---|---|---|---|---|---|---|---|---|---|---|
| | | | | | | | | | | |
| | | | | | | | | 20 to 50 | v1 | |
| | | | | | | | | 20 to 50 | v2 | |
| | | | | | | | | 20 to 50 | v3 | |

Movement in ° or mm v1 = rapid (4-8 sec. per cycle)
v2 = medium (1 minute per cycle)
v3 = slow (10 minutes per cycle)

Fig. 16 (lower left)

| | | | | | | |
|---|---|---|---|---|---|---|
| | | | | | | **Movement programs in the upright sitting position** |
| | | | | | | Exercise for the lumbar vertebrae |
| | | | | | | |
| | | | | | | |

Time in minutes

Fig. 16 (lower right)

Movement Programs for Motor Control
| Pr. No. | Sketch | Motor 1 Head | | | Motor 2 Back | | | Motor 3 Lumbar vertebrae | | |
|---|---|---|---|---|---|---|---|---|---|---|
| | | Travel (°) | v | t (min) | Travel (°) | v | t (min) | Travel (mm) | v | t (min) |
| | | | | | | | | 10 to 30 | v1 | |
| | | | | | | | | 10 to 30 | v2 | |
| | | | | | | | | 10 to 30 | v3 | |
| | | | | | | | | | | |
| | | | | | | | | | | |
| | 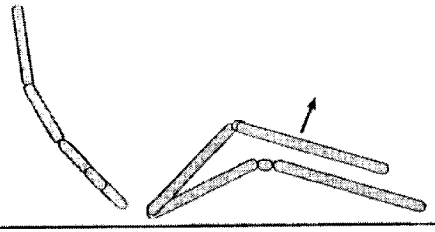 | | | | | | | | | |
| | | | | | | | | | | |
| | | | | | | | | | | |
| | | | | | | | | | | |
Fig. 17 (top left)

| Motor 4 Leg | | | Motor 5 Knee | | | Comment |
|---|---|---|---|---|---|---|
| Travel (°) | v | t (min) | Travel (°) | v | t (min) | |
| | | | | | | |
| | | | | | | |
| | | | | | | |
| | | | | | | |
| | | | | | | |
| 15° - 30° | v1 | | 15° - 0° | v1 | | Exercise for the hip and the knee |
| 15° - 30° | v2 | | 15° - 0° | v2 | | |
| 15° - 30° | v3 | | 15° - 0° | v3 | | |
| | | | | | | |

Fig. 17 (top right)

| | | | | | | | | | | |
|---|---|---|---|---|---|---|---|---|---|---|
| | | | | | | | | 20 to 50 | v1 | |
| | | | | | | | | 20 to 50 | v2 | |
| | | | | | | | | 20 to 50 | v3 | |
| | | | | | | | | 10 to 30 | v1 | |
| | | | | | | | | 10 to 30 | v2 | |
| | | | | | | | | 10 to 30 | v3 | |
| | | | | | | | | | | |
| | | | | | | | | | | |
| | | | | | | | | | | |

Movement in ° or mm v1 = rapid (4-8 sec. per cycle)
v2 = medium (1 minute per cycle)
v3 = slow (10 minutes per cycle)

Fig. 17 (lower left)

| | | | | | | |
|---|---|---|---|---|---|---|
| 15° - 30° | v1 | | 15° - 0° | v1 | | Exercise for the lumbar vertebrae, hip and knee |
| 15° - 30° | v2 | | 15° - 0° | v2 | | |
| 15° - 30° | v3 | | 15° - 0° | v3 | | |
| 15° - 30° | v1 | | 15° - 0° | v1 | | |
| 15° - 30° | v2 | | 15° - 0° | v2 | | |
| 15° - 30° | v3 | | 15° - 0° | v3 | | |
| | | | | | | |
| | | | | | | |
| | | | | | | etc. |

Time in minutes

Fig. 17 (lower right)

Movement Progarms for Motor Control

| Pr. No. | Sketch | Motor 1 Head | | | Motor 2 Back | | | Motor 3 Lumbar vertebrae | | |
|---|---|---|---|---|---|---|---|---|---|---|
| | | Travel (°) | v | min | Travel | v | min | Travel (mm) | v | min |
| | | | | | | | | | | |
| | | | | | | | | | | |
| | | | | | | | | | | |
| | | | | | | | | | | |
| | | | | | | | | | | |
| | | | | | | | | | | |
| | | | | | | | | | | |
| | | | | | | | | | | |
| | | | | | | | | | | |

Movement in ° or mm v1 = rapid (4-8 sec. per cycle)
v2 = medium (1 minute per cycle)
v3 = slow (10 minutes per cycle)

Fig. 18

| Motor 4 Leg | | | Motor 5 Knee | | | Comment |
|---|---|---|---|---|---|---|
| Travel | v | min | Travel | v | min | |
| | | | | | | |
| | | | | | | |
| | | | | | | |
| | | | | | | |
| | | | | | | |
| | | | | | | |
| | | | | | | |
| | | | | | | |
| | | | | | | |

Time in minutes

Fig. 18

BED

BACKGROUND OF THE INVENTION

The invention relates to a reclining device having a body support or mattress support as the reclining surface with several movable parts which can adjust the shape of the curvature of the spinal column. The lumbar vertebrae are thought of here specifically, but also other regions of the spinal column. In the case of such a reclining device it can be, for example, a slatted frame for a bed, a recliner, a mattress, a waterbed, equipment for spinal column therapy or an armchair which can be converted into a recliner.

With many bedframes the head section, the back section and/or the foot section is adjustable so that a more comfortable position can be adopted.

The previous assumption was that a hollow back (lordosis) is positive, because it supports the natural curvature of the spinal column. In the case of chairs and seats one therefore usually finds a lumbar pad. For the same reason one can find recommendations, for example, to push a cushion behind the back. A flat or rounded back (kyphosis), on the other hand, was to be avoided according to many recommendations, because great stress was placed on the intervertebral disk. It was assumed that this increased pressure accompanied by a wedge-shaped aperture angle pressed the nucleus of the vertebral disks (nucleus pulposus) to the rear and thus caused problems. These findings were based primarily on in vivo intradiscal studies which were carried out in the sixties. These measurements showed at the time that the stress when sitting was 40% greater than when standing. Since a lumbar lordotic position is assumed when standing, this position was also to be assumed when sitting to reduce the stress on the spinal column. Previous measurements when sitting showed that the stress here can be reduced if lordosis was supported.

However, the inventor has determined with a direct, in vivo measurement of intervertebral disk pressure that the above findings cannot be substantiated. Sitting, according to his new findings, is no more stressful than standing, thus confirming earlier published results which are based on indirect measuring methods. Pressure in the intervertebral disk in the previously maligned, casual sitting position, i.e. when sitting with a rounded back, can be reduced to one half. (Wilke, H. J., Neef, P., Caimi, M., Hoogland, T., Claes, L. E., New in vivo measurements of pressures in the intervertebral disc in daily life. *Spine* 1999, Apr 15; 24 (8): 755–62). This maligned, casual, but comfortable sitting position with the back slightly rounded creates significantly less stress on the intervertebral disk than the previously recommended upright sitting position with lordosis, i.e. with lumbar lordosis. These contradictions vis-a-vis the earlier results can be attributed to the different measuring technique.

Through the studies conducted by the inventor it has been shown that a changing compressive load in the intervertebral disk is desirable because the intervertebral disk can be nourished thanks to its "sponge principle (Wilke, H-J, Claes L. E., (eds.) (1998) The traumatic and degenerative intervertebral disk, Springer Verlag, Heidelberg, ISBN 3-540-65108-X). With the knowledge of these facts, the object of the invention is to create a reclining device of the type named at the beginning, with which it is possible alternately to impose a load on and remove a load from the human spine and other joints.

This object is achieved by means of a reclining device in accordance with claim 1 as well as a method in accordance with claim 13. Advantageous further forms of the inventive reclining device and of the inventive method are given in the specific dependent claims.

SUMMARY OF THE INVENTION

The above object is achieved in the case of a reclining device of the type named at the beginning under the invention through the recliner frame, for example, being automatically adjustable back and forth between a lordotic position and a kyphotic position. Care should be taken to ensure even lumbar support for the person lying down.

Under the invention the reclining device is adjustable at least partially by sections for height and/or inclination, where the support of the reclining device is repeatedly adjustable in a predetermined fashion by the drive. This means, for example, when dealing with a slatted frame, with respect to individual slats as sections or several slats joined to each other as one section, that the support is adjustable such that these sections can be raised from the flat surface or can be tilted to it. Particularly in the case that a mattress is placed on this slatted frame, the mattress smooths out this raising or tilting, so that a consistent arching of the mattress surface takes place at the spot at which the slat or the section of slats was raised from the support profile.

Under the invention this profile is automatically adjusted by a drive in a repetitive manner, so that the back of the person lying on the mattress is moved back and forth constantly repeatedly between different positions, for example between a lordotic and kyphotic position of regions of the human spinal column, such as lumbar vertebrae, thoracic vertebrae and cervical vertebrae. The same is also possible, for example, for the legs, hips or knees or for the chest, shoulder, neck and head area. As the result of an oscillating, or periodic, movement of this type, the spinal column of the person lying on the mattress is constantly bent in different directions, so that an optimal, changing loading and unloading of the different structures of the spinal column (ligaments, bones, cartilage and so on) and nourishment of the intervertebral disks is possible, while the person on the bed, for example, relaxes or sleeps.

According to the prior art, spinal column curvature is not adjusted selectively to the anatomical and biomechanical particulars of an individual. In the present invention the intent is to be able to selectively adjust the contour of the back and thus the shape of the spinal column by means of the reclining device. The intent is for the spinal column to be able to adopt both a lordotic as well as a kyphotic position.

Ideally, before a reclining device of this type is used, readings with respect to anatomical and/or biomechanical particulars of a person are determined section by section, for example, about the flexibility of the spinal column of the person lying on it, for example for the cervical vertebrae or lumbar vertebrae, where for example the severest possible dislocations in the kyphotic or lordotic position are determined. From these readings and, if necessary, from information about health requirements for the person, for example, special training programs for particular illnesses or restrictions occasioned by illness with respect to the mobility of individual joints or sections of the spinal column, control values can be obtained to activate the inventive reclining device so that the person lying on it is moved back and forth in a manner adapted individually to his anatomical particulars, such as for example, the flexibility of his spinal column and his health requirements.

The movement programs can be determined and controlled relative to a reference position, for example, the most comfortable lying position for a person (relative movement program), or also independently of any such reference position (absolute movement program).

Ideally, the reclining device contains controls for the drive to do this, which can be set or programmed correspondingly. It receives its data from a data recording device which records data from outside, which can be the original data from the measurement taken on the person or control data which have already been revised.

A decisive advantage of the present invention is that the reclining device can be tailored completely individually to the individual person, whereby the program, or setting, can be changed over the course of time if the flexibility of the person's spinal column changes. In this way the inventive reclining device consequently adjusts to the person lying on it during its entire life. This can be interesting in the event a reclining device of this type is used in hospitals, where the reclining device can be adjusted in each case to the particular person.

The current school of thought says that the intervertebral disk arches to the rear under flection. In vivo studies by the inventor have shown that this school of thought is incorrect. The opposite is the case. In the case of kyphosis, i.e. with the back rounded, compressive forces act on the front annulus (anterior annulus). These compressive forces cause bulging towards the front. At the same time a tensile strain is created in the rear fibrous ring (posterior annulus). This causes the collagen fibers to stretch and consequently reduces bulging. This can be demonstrated impressively with the aid of an X-ray photograph of the spinal cord using a radiopaque substance (myelography). Experimentally it has been shown that under flection the nucleus is displaced to the rear, however this displacement is far less than has been reported previously. At the same time, the posterior portion of the outer intervertebral ring tends to move slightly inwards. A slight change can be observed if the nucleus in the intervertebral disk is missing because of a herniated intervertebral disk or an operation. The outer fibrous ring however behaves similarly. Patients with a restriction of the spinal cord (spinal cord stenosis or similar) open even these canals in kyphosis and remove the pressure from the nerve structures. Even the blood circulation in the space surrounding the spinal cord (epidural space) is improved.

The diffusion of dissolved materials can take place in the lordotic position more easily into the anterior half of the intervertebral disc than into its posterior half. This imbalance is reversed in the bent position. Diffusion is more pronounced overall in the kyphotic position, in fact considerably more pronounced in the posterior part of the disk than with an upright posture.

When bending to the rear, i.e. with severe lordosis, there is an increased compressive load on the vertebral joints. The compressive forces continue to increase on the posterior portion of the intervertebral disk's fibrous ring and between the spinous processes. A constant hyperlordosis provides the initial stimulus for arthrosis in the small vertebral joints. The constant hyperlordosis results in the painful phenomenon of Bastrop syndrome. A fixed lordotic position results over the long term in abbreviated musculature.

For the reasons mentioned above, it can be positive if a user can select either a lordotic or a kyphotic position when lying. Static, or forced, postures respectively make no sense in most cases, or are even harmful. For this reason multiple problems arise simply because of a static posture when sitting or even when sleeping, etc. This is clear to everyone if he reads a book, for example, for an extended period, even in a comfortable slanting position for the back. The muscles fatigue, certain parts of the ligaments are stretched unilaterally, certain parts of the intervertebral disc are compressed or put under tension. The fluid of the cartilage in the facets of the joint is pressed out, for example, and diffusion of nutrients is no longer assured. These structures all need a changing load. For this reason, the back should be moved in these static positions.

This obvious disadvantage represents a particular problem for persons who are forced to lie on their back over an extended period.

From the advantages and disadvantages named above it follows that there is no optimal curvature for the spine, if it is assumed statically. When lying, one's position is constantly being changed to put different and alternating demands on the structures. This also means that a kyphotic position cannot be advised against absolutely, but that it should be assumed in a dynamic alternation with the lordotic position. If the tissues of the motor apparatus of the recliner user are conditioned by movement and load, they receive the mechanical stimuli that they require to maintain their structure. Multiple loads cause bones and musculature to increase in mass and improves their biomechanical properties. In addition, the cells of these tissues react with intensified cell propagation and with increased metabolic activity (Neidinger-Wilke, C.; Wilke, H-J, Claes, L. Cyclic Stretching of Human Osteoblasts Effects Proliferation and Metabolism: A New Experimental Method and its Application, *Journal of Orthopedic Research*, No. 12, pp. 70–78, 1994).

The nourishment of cartilage and intervertebral disks takes place through diffusion, which benefits enormously from alternating loads of this kind. Under heavy loads, the fluid is pressed out of the tissues in question, whereby depleted metabolic products are carried away. Then, with the load removed, the tissues can fill themselves to capacity again by soaking up fluid and nutrients like a sponge. If the aforementioned dynamic alternating load is lacking, the cartilage and intervertebral discs no longer receive adequate nourishment and they react by degenerating. It follows that the intervertebral disk of a person in the lying position should be exposed to alternating loads and moved in a variety of ways. This is done involuntarily while sleeping by constantly turning. This is also possible through the inventive dynamic reclining device, in which the back section is adjustable back and forth continuously, preferably oscillating continuously and dynamically between a lordotic position and a kyphotic position, and in this way the supine position can be assumed over an extended period. This holds true in a corresponding way for exercising legs, knees and hips, which should be moved continuously in an alternating fashion.

It has proven to be advantageous in the case of the reclining device according to the invention if the amplitude and/or the frequency of the oscillating change in position is adjustable between the lordotic and the kyphotic position. With regard to amplitude, the range can extend between the two extremes, for example, up to 120° between the lower cover plate of lumbar vertebra L1 and the upper cover plate of sacrum S1. The frequency of the dynamic adjustment between the lordotic and the kyphotic position can, for example, lie in the range between magnitudes of 0.5 $sec^{-1}$ to about 1 $hour^{-1}$.

With the inventive reclining device, the dynamically oscillating adjustment between the lordotic position and the kyphotic position can be carried out actively by the user of the reclining device, or automatically by means of drive equipment.

Under the invention the bed shall be furnished with drive equipment, with the aid of which the back section, for example, is adjusted back and forth continuously in dynamic oscillation between a lordotic position and a kyphotic position. With respect to this drive equipment, it can take the form of an electric motor, a hydraulic motor or similar.

This invention will result in a reduction of back pain. One can remain for a longer time in the same angled raised position, for example, in order to read, because the structures are being alternately loaded and unloaded, which, in the absence of this movement, forces the bed user to change his movements. The movement can further reduce atrophy of structures in a bed-ridden person.

It is preferable with the inventive reclining device if the back section is not only dynamically adjustable continuously back and forth between a lordotic position and a kyphotic position, but if the back section is additionally adjustable in its angle. Furthermore, it can be preferable if, in the case of the inventive reclining device, the foot section is similarly moved continuously or discontinuously. Through such embodiments of the last named type, relevant structure of other joints of the bed user, such as cartilage, bones, ligaments and muscles, for example in the hip and in the knees, are also loaded and unloaded when lying and thus conditioned. This results in improved nourishment of these structures and in improved breathing, blood circulation and digestion, and thus also to an improved feeling of well being. Using the following examples and figures the inventive object shall be shown schematically and described in greater detail.

BRIEF DESCRIPTION OF THE INVENTION

FIGS. 13 to 18 show specific movement programs taking different biomechanical objectives into consideration.

DETAILED DESCRIPTION OF THE PREFERRED EMBODIMENT

Figure 1:
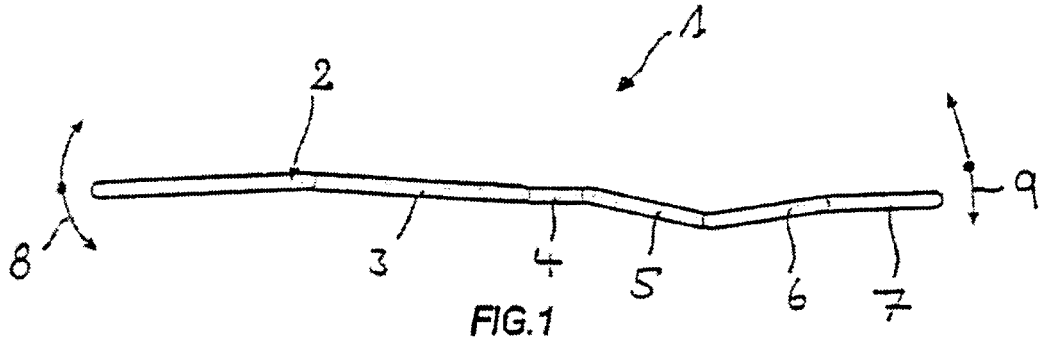
FIG. 1 shows a reclining device in a first position.

FIG. 1 shows schematically in a side view an embodiment of a reclining device 1 having a leg section 2, 3 (here in two parts as an example) and a multi-part (here four-part as an example) back section 4 to 7. The leg section 2 and the head section 7 are, like the other areas 3 to 6, adjustable in their inclination. This is indicated by the curved arrows 8 and 9 respectively.

In FIG. 1 the reclining device 10 is assuming a position in which the back section is inclined flat downward, and the back section permits a kyphosis.

The same or similar elements are identified in FIG. 2 as in the following figures, with the same reference number as in FIG. 1, so that it is superfluous to describe these elements each time again in detail.

Figure 2:
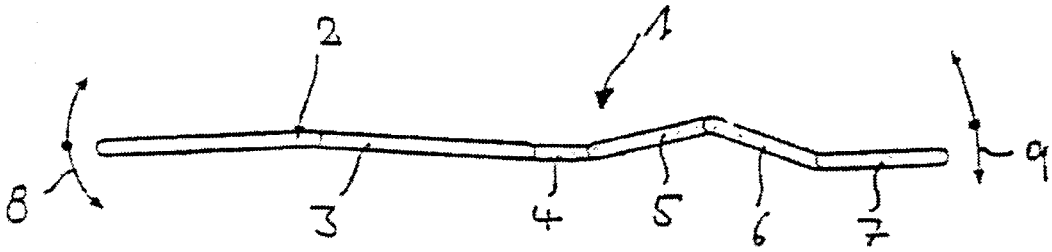
FIG. 2 shows a reclining device from FIG. 1 in a second position.
Figure 3:
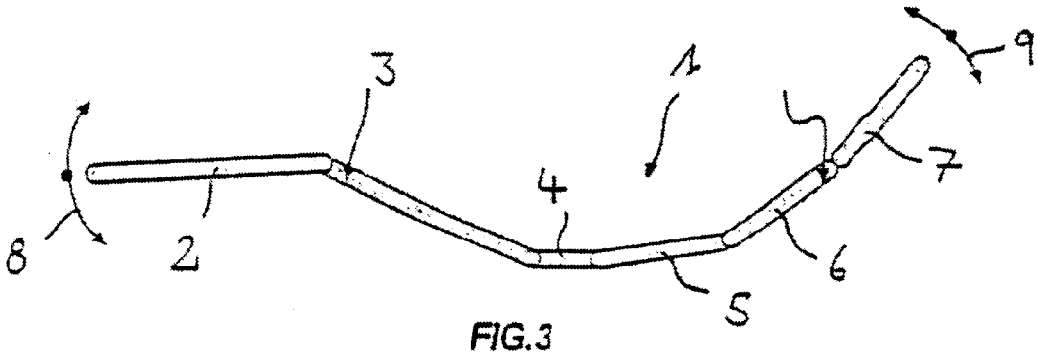
FIG. 3 shows a reclining device from FIGS. 1 and 2 in a third position.
Figure 4:
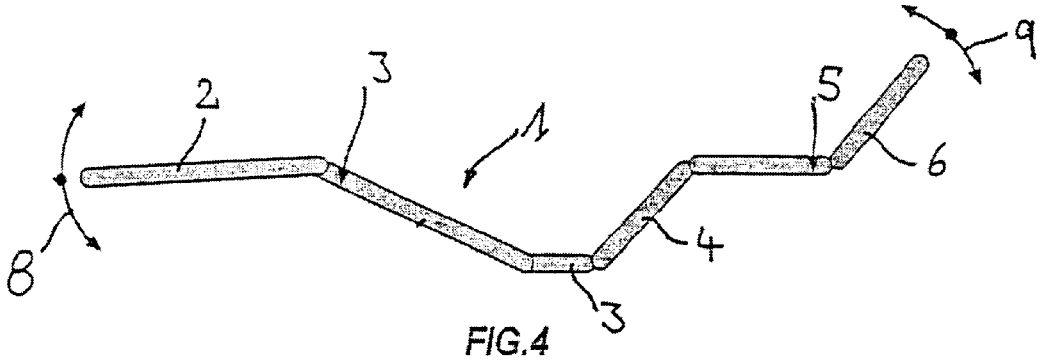
FIG. 4 shows the reclining device in a fourth position.

In the case of the reclining device 1, the back section made up of the segments 4 to 7 can be adjusted back and forth continuously in dynamic oscillation between the lordotic position shown clearly in FIG. 2 and the kyphotic position suggested in FIG. 1 (see arrow 9). This adjustment can be made actively by the user of the recliner or passively and automatically by means of a suitable drive device (not shown). This drive device can be an integral part of the reclining device 1. FIG. 3 shows in a schematic side view similar to FIGS. 1 and 2 the reclining device 1 swung upward, compared to the flat positions depicted in FIGS. 1 and 2. In FIG. 3 the contour of the back section 4 to 7 is configured in such a way that the user adopts a kyphotic posture. FIG. 4 clearly shows the lordotic posture in this straightened position. Here too, this back section 2 can be continuously or discontinuously adjustable.

Figure 5:
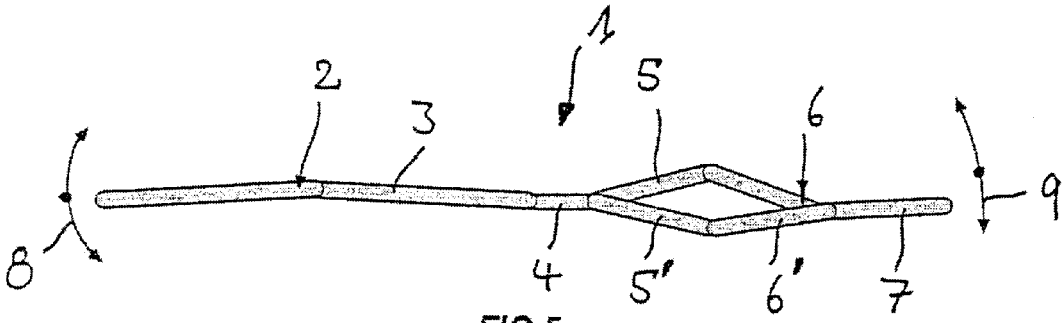
FIG. 5 shows two different positions of the reclining device corresponding to the positions from FIGS. 1 and 2.
Figure 6:
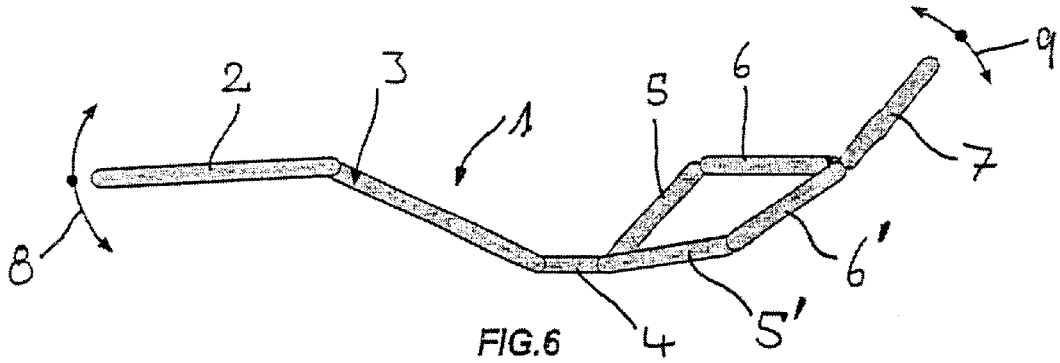
FIG. 6 shows two varied positions of the reclining device corresponding to the positions from FIGS. 3 and 4.

FIG. 5 shows clearly a continuous adjustment of the reclining device 1 in dynamic oscillation between the position depicted in FIG. 1 and that shown in FIG. 2. In contrast, FIG. 6 shows clearly a dynamic adjustment variation, in which the oscillating adjustment of the back section 12 between the position depicted in FIG. 3 and that in FIG. 4 accompanies an inclination adjustment of the back sections 5 and 6. The two settings in the maximally extended positions of the bed are identified by 5 and 6, or 5' and 6' respectively.

In FIG. 5 and FIG. 6 a different position for the leg sections 2 and 3 can also be seen, which, in the same way as the back section, are continuously and discontinuously movable between different positions with adjustable frequency and amplitude.

Figure 7:
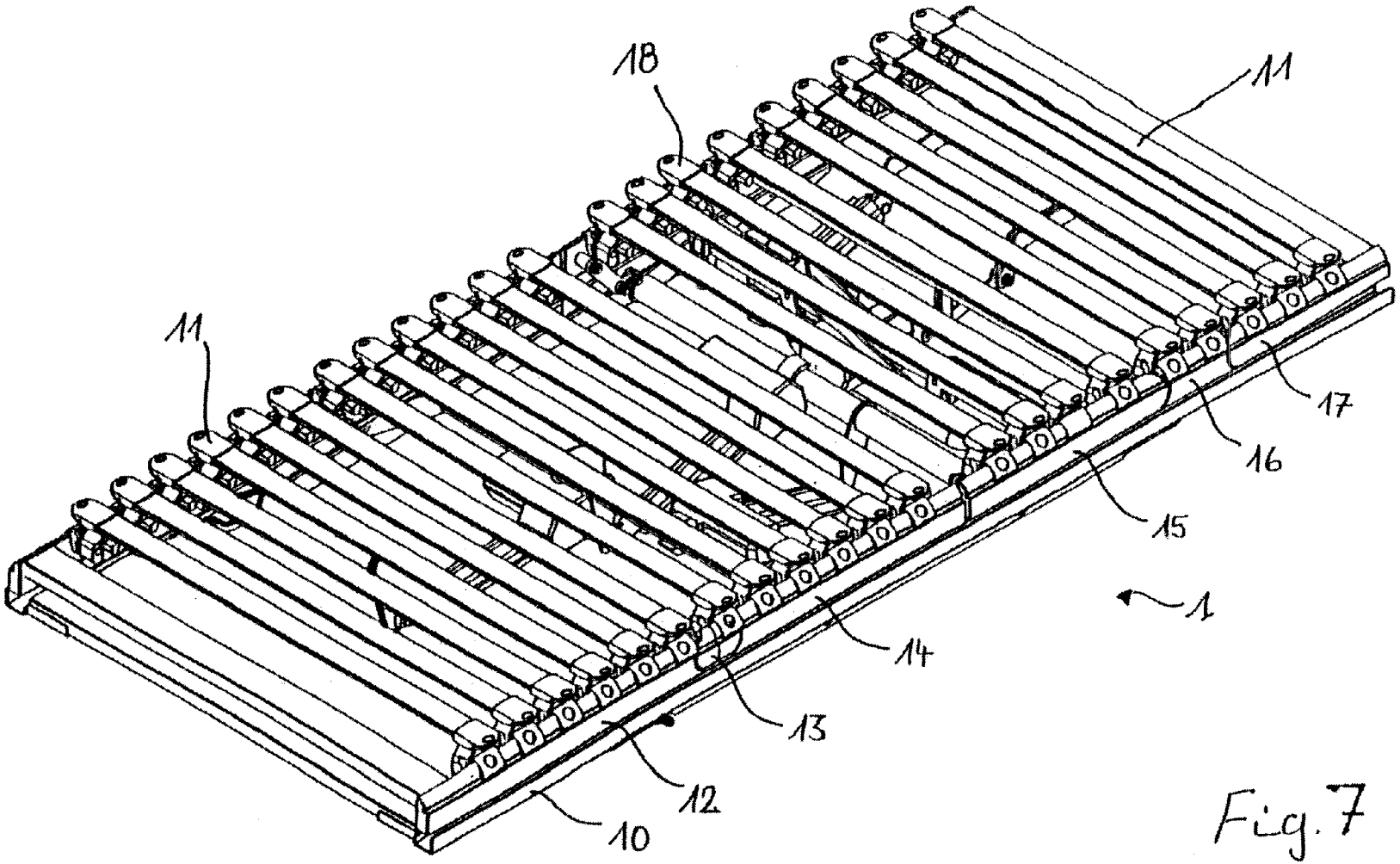
FIGS. 7 to 10 show a reclining device according to the invention in different positions.

A reclining device in accordance with the invention is shown in FIG. 7. This reclining device has a base frame 10, on which a total of six movable frame sections 12 to 17 are located. The frame sections 12 and 13 correspond to a leg support section, and sections 14 to 17 correspond to a support area for the back and head of a person. Each of these support areas 12 to 17 has one or more cross slats 11 on which a mattress can be placed. To this extent it is a traditional slatted frame. Under the invention, however, these slats 11 are not solidly attached to the frame 10, but, in some sections, to the moveable frame 12 to 17, which slats can be adjusted both in their height as well as in their inclination independently of each other. This is carried out by a mechanism located underneath the slatted frame. Specifically in the area of the lumbar vertebrae, a slat 18 is located in the moveable frame 14, which slat for its part can be raised out of the plane of the remaining slats. This is also carried out by means of a mechanism located underneath the bed, for example, a scissors mechanism driven by a motor. When this slat 18 is raised, the mattress above it also arches, whereby, as a result of the rigidity of the mattress, a smooth transition is achieved between the individual heights of the slats. By raising the slat 18, the spinal column of the person lying on the mattress can consequently be moved into the lordotic position.

Figure 8:
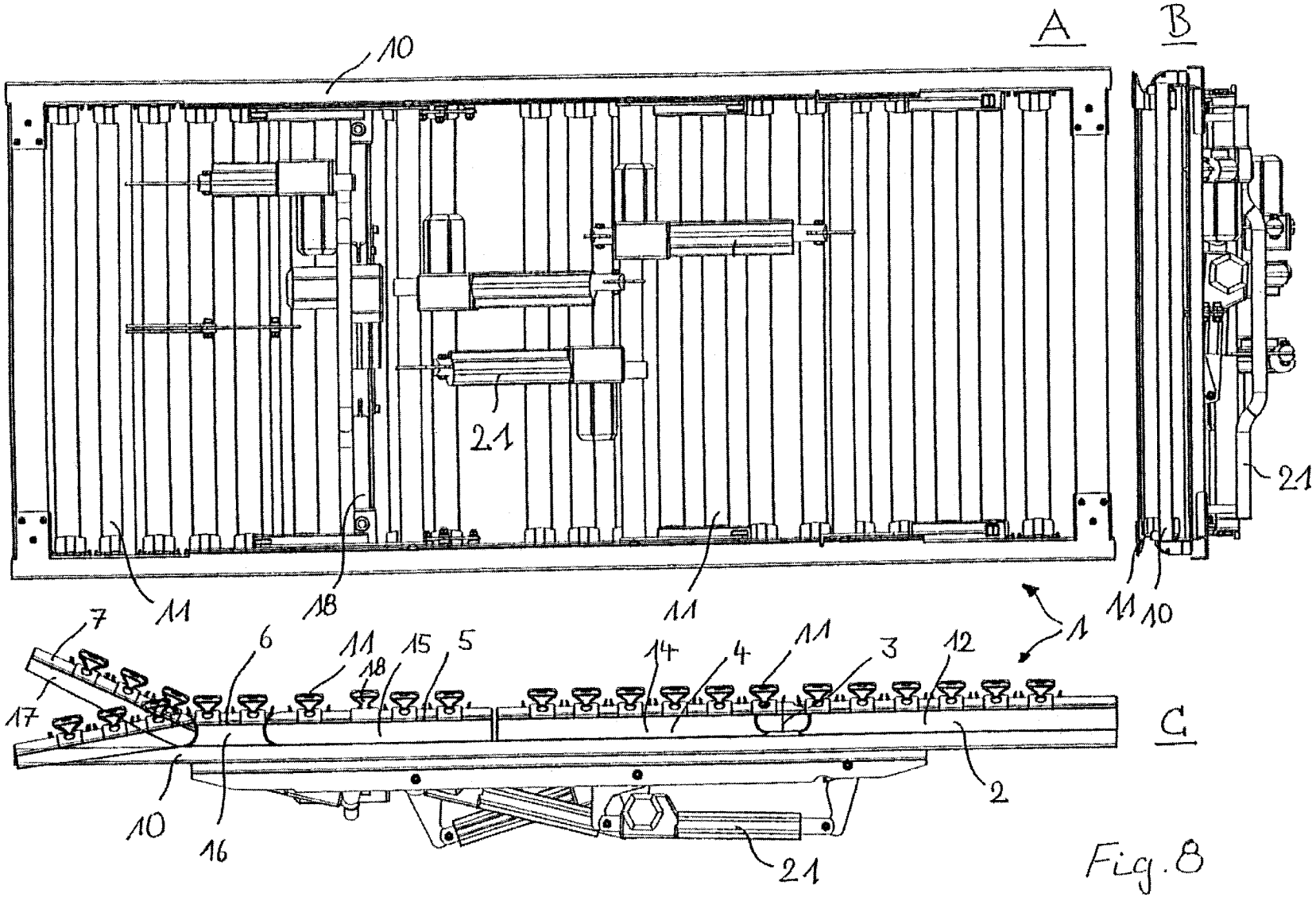

FIG. 8 shows the mechanism of the inventive reclining device 1 from FIG. 7 in three separate views, A, B and C. It can be seen that a mechanism 21 is located underneath the reclining device 1, which is suitable for adjusting the individual frame sections 12 to 17. In FIG. 8*a* there is a view of the bed from below, in FIG. 8*b* in cross section from the head end and in FIG. 8*c* in a side view along the longitudinal side. In FIG. 8*c* it can be seen that the head section 12 can be moved up and down to achieve, for example, an overextension of the thoracic vertebrae in the downwardly inclined position. The adjustability of the head section can also be used, for example, to set an anti-snoring position or an anti-sleep apnea position. In such a case under the invention, a sensor for the sound of snoring or sleep apnea can be built into the bed, so that if snoring or a sleep apnea occurs the head area is suitably adjusted, or moved cyclically if necessary, and as a result the snoring, or the apnea respectively, is eliminated.

Figure 9:
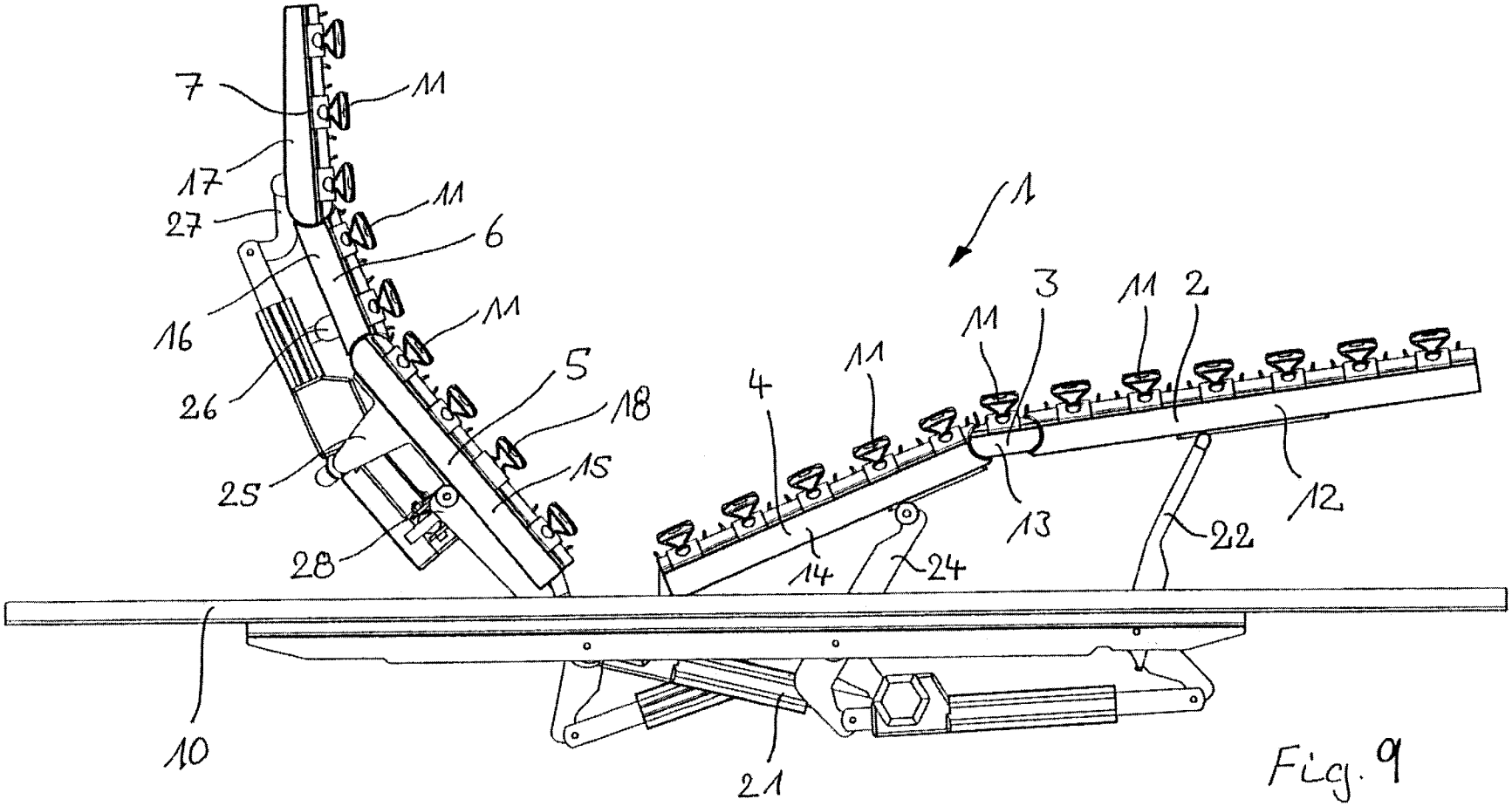

FIG. 9 shows the same inventive bed, where the individual areas 2 to 7 are raised and tilted so that the person on them would be in a seated position with raised legs. The moveable frames 12 to 17 are clearly recognizable, brought into position and kept there by adjusting mechanisms 22 to 27. Furthermore, the slat 18 responsible for the lordotic position and its mechanism can also be seen.

Figure 10:
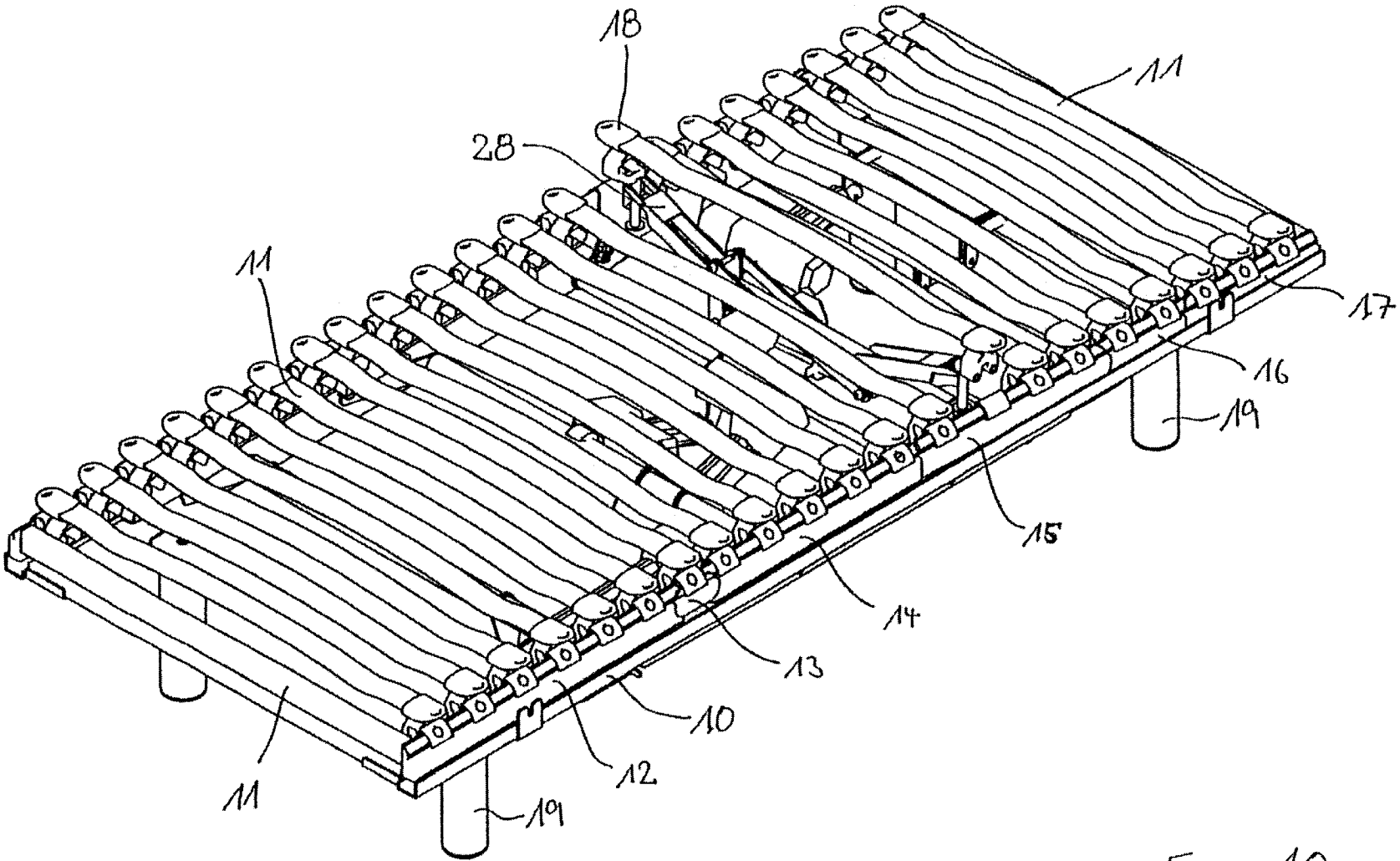

This lordotic position of the reclining device is shown in FIG. 10. In this figure all the moveable frames 12 to 17 are in the flat position, such as is normal for a person to sleep, for example. However, slat 18 is raised out of this profile by means of the scissors mechanism 28, which is located in the moveable frame 15. With the slat in this position, the mattress is raised at this point so that the person on it lying on his back assumes a lordotic posture. Under the invention this slat 18 can, for example, can be moved up and down automatically in an oscillating fashion, so that the spinal column of the person lying on it is constantly moved between lordotic posture and kyphotic posture. This results in the desired advantageous effects on the person's spinal column.

A complete reclining device is shown in FIG. 10, which also has legs 19.

Consequently, under the invention all the moveable frames 12 to 17, or slat 18 as well, can be moved periodically back and forth between various positions by the reclining device.

Figure 11:
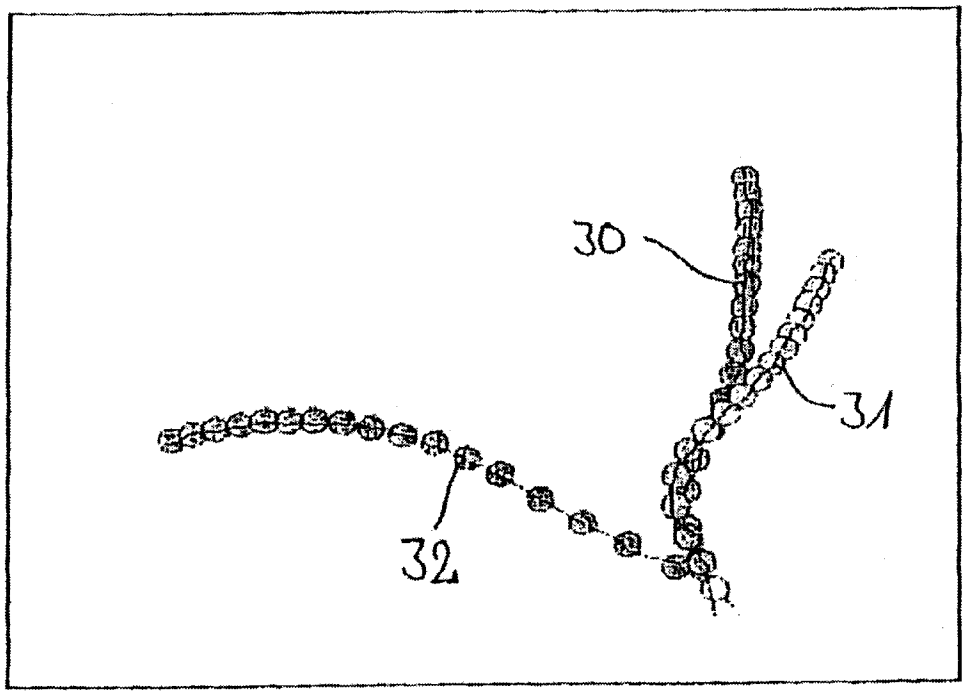
FIG. 11 shows the flection/extension of a human spinal column in three different standing positions.

The optimal reversing points for the individual movements can be established by determining, as in FIG. 11, the maximum possible extensions of the person's spinal column. Three extreme positions for the spinal column are shown in FIG. 11, where the normal position of the spinal column for a standing person is shown with the reference number 30, the maximum position of a person leaning back with reference number 31 and the maximum position leaning forward with reference number 32.

Figure 12:
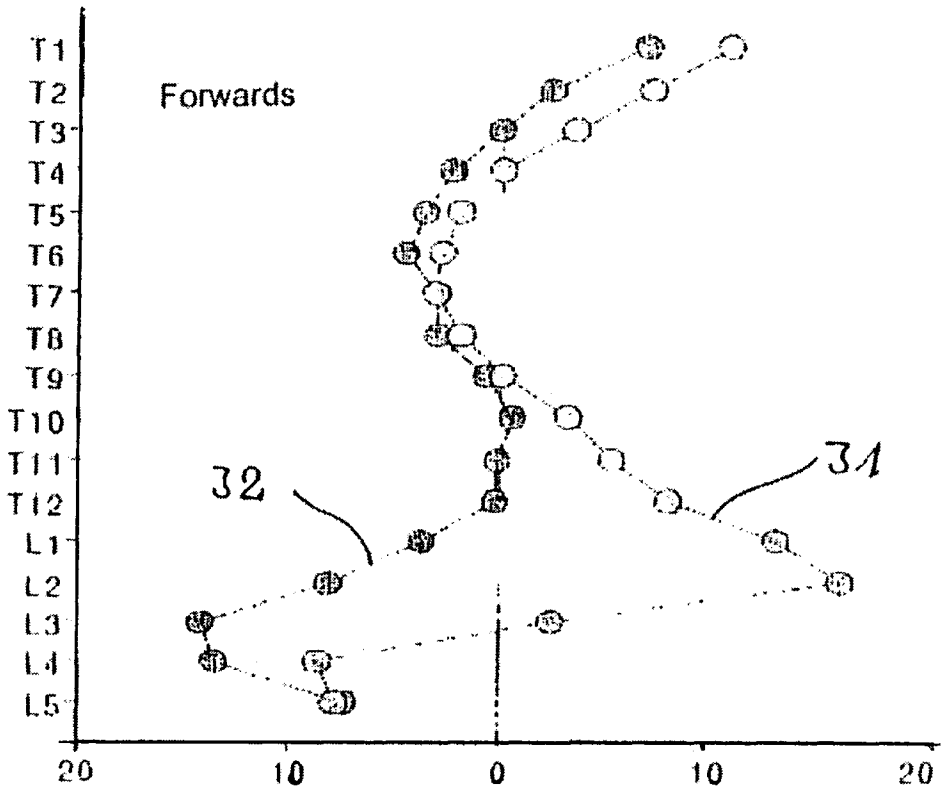
FIG. 12 shows the flection/extension mobility of the spinal column depicted in FIG. 11.

FIG. 12 shows an analysis of this measurement from FIG. 11, where 31 indicates the mobility of each individual vertebra in the maximum backward position (lordotic position) and 32 shows the mobility of the spinal column in the maximum forward position (kyphotic position). A measurement of this type can be performed using, for example, the CMS30/70P measuring system and the Winspine program from Zebris Medizintechnik GmbH, Isny, Germany. Once the maximum extension points of the spinal column have been determined in this way, the inventive reclining device can be programmed so that it moves the moveable frames 12 to 17 and slat 18 back and forth in such a way that the spinal column of the person lying on it is moved back and forth between its two maximum extension points. This exercises the spinal column and the other joints. In order to program the bed, it can be furnished with read-in equipment (data recording device), for example, a chip card reader, a data input device (for example, hand-held selector), an infra-red interface or the like. In this way, the bed can be adjusted to each individual person or, over the course of a person's life, it can be constantly adjusted to his anatomical particulars.

FIGS. 13 to 18 show these types of different movement inputs for motor control of a reclining device under the invention, as shown in FIGS. 7 to 10.

The parameters for the individual movement programs are adapted individually to the anatomical and biomechanical characteristics of the user. Depending on constitution, mobility or stiffness respectively, of the spinal column, state of health or special problems, some movement programs may not be permitted or must be individually adapted (stiff knee or stiff hip, osteoporosis, Bechterew's disease, vertigo, etc.).

A chip card or a hand-held selector should be programmed for this, containing these individual programs for controlling the individual articulations of the reclining device. In order to program this chip card or hand-held selector individually, the customer (the bed user) must first complete a questionnaire in which his relevant data are collected. This is followed by a movement analysis with a movement analysis system as described previously. First of all, when standing erect (FIG. 11), the contour of the entire spinal column is recorded with the help of a scanning probe, starting at the crown of the head over the back of the head. This measurement is repeated when the person bends forward (flexion) and backwards (extension) (FIG. 11). Using these three sets of data, which establish the various amplitudes of the reclining device, the mobility of the individual regions of the spinal column can be determined by means of subtraction (see FIG. 12). Body size, weight, shoulder width, etc. are measured in addition. These data are suitably converted by the computer program to propose a frame size and to determine the individual height and stiffness settings for each slat in the slatted frame.

Nourishment of the intervertebral disk, the cartilage in the small vertebral joints, also in the hip and knee joint, is dependent on amplitude and frequency. It was possible to prove this in bone cells (Neidlinger-Wilke, C.; Wilke, H-J, Claes, L. Cyclic Stretching of Human Osteoblasts Effects Proliferation and Metabolism: a New Experimental Method and its Application, *Journal of orthopedic Research*, No. 12, pp. 70–78; 1994). However, this could be different in the case of those suffering from osteoporosis or other problems (Neidlinger-Wilke, C.; Stalla, I.; Claes, L.; Brand, R.; Hoellen, I.; Rübenacker, S.; Arand, M.; Kinzl, L.: Human osteoblasts from younger normal and osteoporotic donors show differences in proliferation and TGF beata-release in response to cyclic strain, *J BiomechanicsI* 28: 1411–1418 (1995)).

Moreover, these different programs can be of different duration.

If, for example, back pain occurs at night, the bed user no longer has to get up and walk around for a few minutes so that the spinal column is moved, but instead he runs a program which moves his lumbar vertebrae cyclically. This program should switch off automatically after 15 minutes and move the bed into the normal position for sleep (memory setting).

Movements for the different joints are also conceivable with very small amplitudes during the entire night. In the case of bed-ridden patients, for example, a specific individual program can run for the entire day.

In the reading setting, a particular sequence of movements can take place as desired over a period of 1 hour, back pains which force the user to shift his position no longer occur. That means, one can remain in the upright position for reading longer than normal.

What is claimed is:

1. Reclining device comprising a body or mattress support and at least one drive with which the support can be adjusted for height and/or tilt in the longitudinal direction of the bed, at least in sections, wherein the reclining device additionally has a data recording device for recording data relating to the constitution, mobility and stiffness of a user, taking into consideration his state of health and special health problems and for transmitting data to a control unit which periodically regulates the drive and wherein the data represents information about at least one of the flexibility of the spinal column, and the flexibility of other joints.

2. Reclining device in accordance with claim 1, wherein the support has a back support section which can be alternately adjusted by the drive between kyphotic setting and lordotic setting.

3. Reclining device in accordance with claim 2, wherein the back support section can be controlled in its tilt independently of the lordotic or kyphotic setting.

4. Reclining device in accordance with claim 1, wherein the support has a support section for head and shoulders which is alternately adjustable between a setting for head tilted forward and a position for head tilted back.

5. Reclining device in accordance with claim 1, wherein the support has a leg support section which is adjustable by the drive between a position for extended knee and a position for bent knee, or between a position for extended hips and a setting for bent hips.

6. Reclining device in accordance with claim 1, characterized by a control device for regulating the drive.

7. Reclining device in accordance with claim 1, wherein the drive can be controlled in such a fashion that it repeatedly changes the support at least by section between two positions compatible with the anatomy of a particular person.

8. Reclining device in accordance with claim 1, wherein the amplitude and/or frequency of the adjustment of the support can be adjusted or controlled.

9. Reclining device in accordance with claim 8, wherein the data recording device is a reader for data carriers, such as chip cards, magnetic cards, magnetic tapes or the like, or an interface for data transmission such as an IR interface, a serial or parallel interface or the like.

10. Reclining device in accordance with claim 1, wherein it has a sensor for snoring or a sensor for sleep apnea, by means of whose output signals the drive can be controlled.

11. Method for operating a reclining device having a body and/or mattress support, comprising the steps of:

adjusting the profile of the support of the reclining device in its longitudinal direction, at least sectionally, for height and/or inclination;

recording data by means of a data recording device which relate to the constitution, mobility and stiffness of a user, taking into consideration the user's state of health and special health problems, and wherein the data represents information about at least one of the flexibility of the spinal column and, the flexibility of the other joints;

and transmitting the data to a control device so that it the control device periodically controls the drive.

12. Method in accordance with claim 11, wherein the support is alternately adjusted in a back support section between kyphotic setting and lordotic setting.

13. Method in accordance with claim 12, wherein the back support section is adjusted in its inclination independently of the lordotic or kyphotic setting.

14. Method in accordance with claim 11, wherein the support is alternately adjusted in a support section for head and shoulders between a setting for head tilted forward and a setting for head tilted to the rear.

15. Method in accordance with claim 11, wherein the support is adjusted in a leg support section between a setting for extended knee and a setting for bent knee.

16. Method in accordance with claim 11, wherein the amplitude and/or frequency of the adjustment of the support is regulated.

17. Method in accordance with claim 16, wherein information about the flexibility of the spinal column of the person is recorded as data or as data derived from this information.

18. Method in accordance with claim 11, wherein the data are recorded by the reclining device by means of a reader for data carriers, such as chip cards, magnetic cards, magnetic tapes and the like, or by means of an interface for data transmission such as an IR interface, a serial or parallel interface or the like.

19. Method in accordance with claim 11, wherein data are taken from a specific person concerning his anatomical particulars and indirectly and/or after processing into data derived from these particulars, these data and/or the derived data are transmitted to the reclining device.

20. Method in accordance with claim 11, wherein control data for the type and sequence of the adjustment of the support are established in the reclining device or prior to the transmission of the data to the reclining device from the data concerning the anatomical particulars of the person.

21. Method in accordance with claim 11, wherein the support is repeatedly moved back and forth at least by sections between two settings compatible with the anatomy of a particular person.

22. Method in accordance with claim 11, wherein the profile of the support is changed when snoring or sleep apnea occurs in the person lying on the support.

23. Reclining device in accordance with claim 6, wherein the control unit periodically regulates the drive.

* * * * *